US010970964B2

(12) United States Patent
Zhao

(10) Patent No.: US 10,970,964 B2
(45) Date of Patent: Apr. 6, 2021

(54) TRIGGERING IN-APPLICATION CURRENCY TRANSFER

(71) Applicant: PAYPAL, INC., San Jose, CA (US)

(72) Inventor: Lucy Ma Zhao, Austin, TX (US)

(73) Assignee: PAYPAL, INC., San Jose, CA (US)

( * ) Notice: Subject to any disclaimer, the term of this patent is extended or adjusted under 35 U.S.C. 154(b) by 19 days.

(21) Appl. No.: 16/357,088

(22) Filed: Mar. 18, 2019

(65) Prior Publication Data

US 2019/0279463 A1 Sep. 12, 2019

Related U.S. Application Data

(63) Continuation of application No. 15/602,986, filed on May 23, 2017, now Pat. No. 10,235,836, which is a continuation of application No. 13/754,064, filed on Jan. 30, 2013, now Pat. No. 9,659,443.

(51) Int. Cl.

| | |
|---|---|
| ***G07F 17/32*** | (2006.01) |
| *G06Q 30/00* | (2012.01) |
| *A63F 9/24* | (2006.01) |

(52) U.S. Cl.

CPC ..... *G07F 17/3244* (2013.01); *G07F 17/3281* (2013.01); *A63F 9/24* (2013.01); *G06Q 30/00* (2013.01)

(58) Field of Classification Search

CPC ..... G07F 17/3276; G07F 17/3244; G07F 17/3281; G06Q 30/00

See application file for complete search history.

(56) References Cited

U.S. PATENT DOCUMENTS

| | | | | |
|---|---|---|---|---|
| 6,077,162 | A | 6/2000 | Weiss | |
| 7,458,510 | B1 * | 12/2008 | Zhou | G06Q 20/18 235/379 |
| 7,734,545 | B1 | 6/2010 | Fogliano et al. | |
| 9,345,973 | B1 | 5/2016 | Antkowiak | |
| 2002/0160838 | A1 | 10/2002 | Kim | |
| 2004/0242297 | A1 * | 12/2004 | Walker | G07F 17/3276 463/13 |
| 2004/0266534 | A1 | 12/2004 | Byng | |
| 2006/0160610 | A1 * | 7/2006 | Potts | G07F 17/3255 463/25 |
| 2006/0247037 | A1 | 11/2006 | Park | |
| 2009/0280908 | A1 | 11/2009 | Carroll et al. | |
| 2009/0318220 | A1 * | 12/2009 | Arezina | G07F 17/32 463/25 |
| 2009/0318221 | A1 | 12/2009 | Dhunjishaw et al. | |
| 2011/0106675 | A1 * | 5/2011 | Perlman | G06Q 20/14 705/30 |
| 2012/0302328 | A1 | 11/2012 | Walker et al. | |
| 2013/0072308 | A1 | 3/2013 | Peck et al. | |

* cited by examiner

*Primary Examiner* — Omkar A Deodhar
*Assistant Examiner* — Ross A Williams
(74) *Attorney, Agent, or Firm* — Haynes and Boone, LLP

(57) ABSTRACT

Systems and methods are disclosed for electronically transferring currency from a source user account to a target user account in relation to a game application. A payment service provider may receive a request to transfer an amount of currency from the source user account to the target user account to be used for the game application.

20 Claims, 6 Drawing Sheets

TRIGGERING IN-APPLICATION CURRENCY TRANSFER

CROSS REFERENCED TO RELATED APPLICATIONS

This application is a continuation of U.S. patent application Ser. No. 15/602,986, filed May 23, 2017, which is a continuation of U.S. patent application Ser. No. 13/754,064, filed Jan. 30, 2013 and issued as U.S. Pat. No. 9,659,443, all of which are incorporated herein by reference in their entirety.

TECHNICAL FIELD

The present disclosure relates generally to electronic currency transfers. In particular, the present disclosure relates to methods and systems for using a computing device to transfer currency from one account to another account in relation to a game application.

BACKGROUND

A game application may support multiple users and allow users playing the game to purchase virtual objects using in-game or virtual currency. For example, a game application for social networking websites, virtual worlds, and online gaming sites may allow characters in the virtual world to own virtual objects within the context of the virtual world (e.g., equipment, land, or weapons). A user may spend "real money" on virtual currency, which may be used to purchase objects of value to assist characters in the game. Real money may refer to currency that is accepted outside of the game context and may be used to purchase in-game or virtual currency. In-game or virtual currency may refer to currency that is accepted in the game and may be used to purchase objects in the game.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
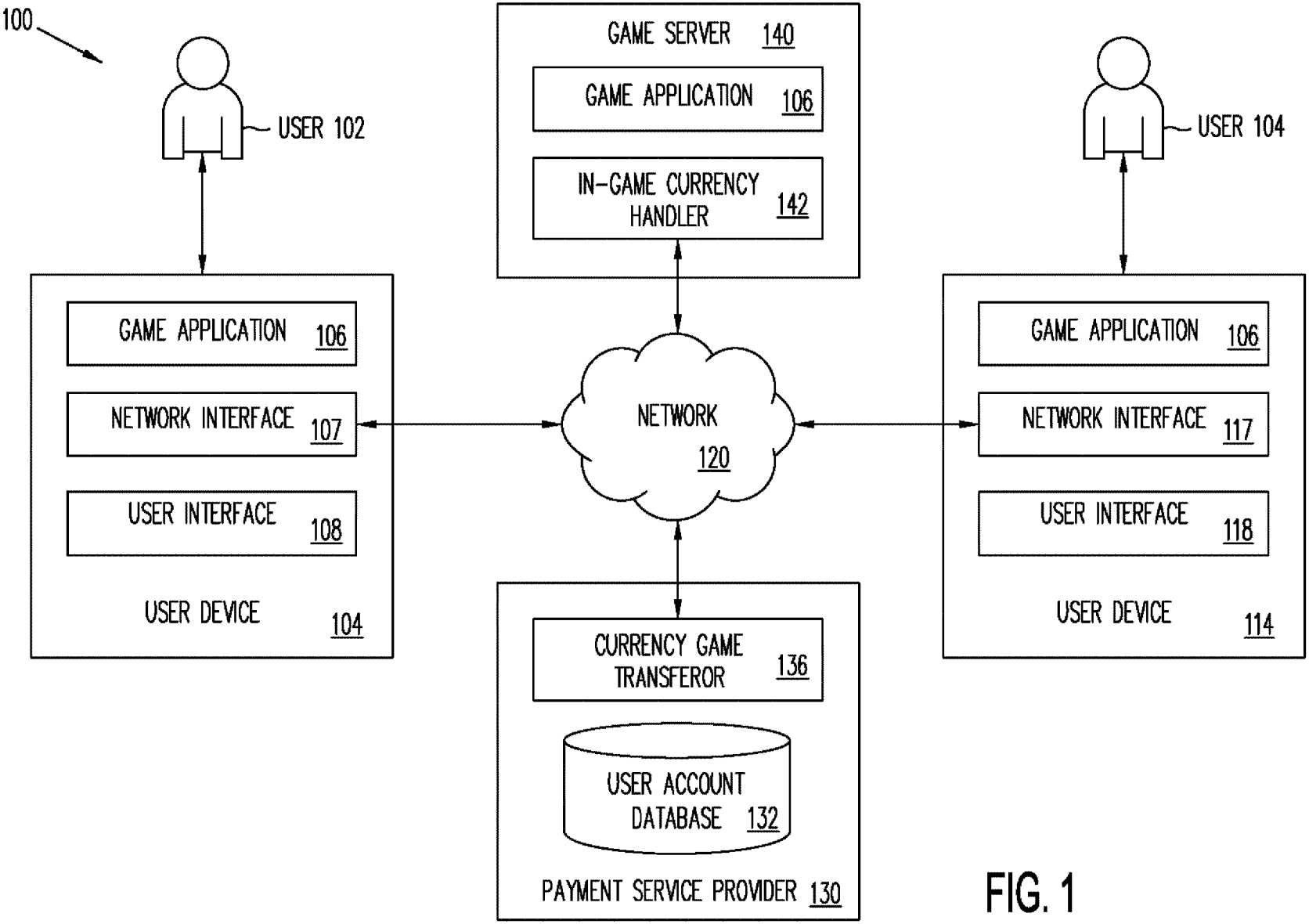
FIG. 1 shows a system for electronically transferring currency from a source user account to a target user account in relation to a game application, according to an embodiment of the present disclosure.

I. Overview
II. Transfer Currency in Relation to a Game Application
III. Example Displays to Specify Transfer Information in Relation to a Game Application
IV. Example Method
V. Example Computing System

I. Overview

Systems, methods, and techniques are disclosed herein for processing currency transfer requests in relation to a game application. In particular, systems, methods, and techniques are disclosed for electronically transferring currency from a source user account to a target user account in relation to a game application.

In an example, the game application is a racing game, and a first user and a second user form a team that races against other players online in the racing game. A user may purchase in-game currency in the racing game, which the user may use to purchase virtual objects such as new tires or premium gasoline in the racing game. Purchasing these objects may increase a team's chances of beating other teams. The team's performance may be affected if, for example, the second user is running low on in-game currency and cannot afford to purchase better equipment for his car. To increase their chances of winning, the first user may want to help his teammate purchase better equipment for his car.

The racing game may be linked to a payment service provider that enables the first user to help this teammate. The payment service provider may be different from the game application provider. The payment service provider may be a payment service provider such as Paypal, Inc. of San Jose, Calif. The payment service provider may store account information on the first and second users and also enable the first user to transfer an amount of currency from the first user's account to the second user's account. In an example, the first user may instruct the payment service provider to transfer an amount of currency from his account to the second user's account for purchasing in-game currency in the racing game. Accordingly, the second user may use a portion or all of the transferred amount of currency to purchase in-game currency for the racing game, and then use the in-game currency to buy new tires for his racing car in the racing game.

In accordance with one or more embodiments of the present disclosure, an apparatus is disclosed. The apparatus includes one or more processors. The apparatus also includes a database for storing user account information on a plurality of users. Each user of the plurality of users has a user account and is associated with one or more game applications. The apparatus further includes a memory that stores machine-readable instructions for execution by the processors to search the database to identify one or more game applications associated with a first user of the plurality of users having a first user account. The identified one or more game applications is linked to a payment service provider. The apparatus transmits the information on the identified one or more game applications to a computing device for display to the first user. The apparatus further receives from the computing device a selection of a game application of the identified one or more game applications. The selected game application is associated with a user selectable option to transfer currency from the first user account to another user account associated with the selected game application via the payment service provider. The apparatus further identifies one or more users of the plurality of users associated with the selected game application. The apparatus further transmits the information on the identified one or more users associated with the selected game application and the information on the user selectable option to transfer currency to the computing device for display to the first user. The apparatus further receives from the computing device a selection of a target user of the identified one or more users associated with the selected game application. The apparatus further receives from the computing device a request to transfer an amount of currency from the first user account of the first user to a target user account of the target user.

In accordance with one or more embodiments of the present disclosure, a method for transferring an amount of currency from a first user account to another user account in relation to a game application is disclosed. The method includes searching, by one or more hardware processors, a database to identify one or more game applications linked to a payment service provider and associated with a first user having a first user account. The method further includes transmitting the information on the identified one or more game applications to a computing device for display to the first user. The method further includes receiving a selection of a game application of the identified one or more game applications. The method further includes identifying one or more users of the plurality of users associated with the selected game application. The selected game application is associated with a user selectable option to transfer currency from the first user account to another user account associated with the selected game application via the payment service provider. The method further includes transmitting the information on the identified one or more users associated with the selected game application and information on the user selectable option to transfer currency to the computing device for display to the first user. The method further includes receiving a selection of a target user of the identified one or more users associated with the selected game application. The method further includes receiving a request to transfer an amount of currency from the first user account of the first user to a target user account of the target user.

In accordance with one or more embodiments of the present disclosure, a non-transitory computer readable medium having computer readable code for execution by one or more processors to perform a method is disclosed. The method includes searching a database to identify one or more game applications linked to a payment service provider and associated with a first user having a first user account. The method further includes transmitting the information on the identified one or more game applications to a computing device for display to the first user. The method further includes receiving a selection of a game application of the identified one or more game applications. The method further includes identifying one or more users of the plurality of users associated with the selected game application. The selected game application is associated with a user selectable option to transfer currency from the first user account to another user account associated with the selected game application via the payment service provider. The method further includes transmitting the information on the identified one or more users associated with the selected game application and information on the user selectable option to transfer currency to the computing device for display to the first user. The method further includes receiving a selection of a target user of the identified one or more users associated with the selected game application. The method further includes receiving a request to transfer an amount of currency from the first user account of the first user to a target user account of the target user.

II. Transfer Currency in Relation to a Game Application

Refer now to the figures wherein the drawings are for purposes of illustrating embodiments of the present disclosure only, and not for purposes of limiting the same.

FIG. 1 shows a system 100 for electronically transferring currency from a source user account to a target user account in relation to a game application, according to an embodiment of the present disclosure. In FIG. 1, a user 102 has a user device 104 and may play a game application 106 running on user device 104. Similarly, a user 112 has a user device 114 and may also play game application 106 running on user device 114. A user device that runs a game application may be a smart phone (e.g., iPhone, Google phone, or other phones running Android, Window Mobile, or other operating systems), a tablet computer (e.g., iPad, Galaxy), personal digital assistant (PDA), a notebook computer, a personal computer, or various other types of wireless or wired computing devices. It should be appreciated that the user device may be referred to as a client device or a computing device without departing from the scope of the present disclosure.

In an embodiment, users 102 and 112 may interact with a game server 140 over a network 120. Network 120 may be implemented as a single network or a combination of multiple networks. For example, in various embodiments, network 120 may include the Internet and/or one or more intranets, wireless networks (e.g., cellular, wide area network (WAN), WiFi hot spot, WiMax, personal area network (PAN), Bluetooth, etc.), landline networks and/or other appropriate types of communication networks.

Game server 140 includes game application 106, which may be downloaded by user 102, 112 over network 120 onto client devices 104, 114. Game server 140 also includes an in-game currency handler 142 that interfaces with network 120 to enable communication with user device 104, user device 114, and a payment service provider 130. For example, in-game currency handler 142 may receive and process requests to purchase in-game currency and to use the purchased in-game currency to purchase objects that may be used in game application 106. Game server 140 may be associated with a particular link (e.g., a link, such as a URL (Uniform Resource Locator) to an IP (Internet Protocol) address).

The user devices may communicate over a network 120 with payment service provider 130. User devices 104, 114 interface with network 120 to enable communication with payment service provider 130. For simplicity, the same user device (e.g., user device 104) is described as both running the game application (e.g., game application 106) and communicating with payment service provider 130. It should be understood, however, that the computing device running the game application may be different from the computer device that communicates with the payment service provider.

User device 104 includes a network interface 107 and a user interface 108 that enable user 102 to interact with payment service provider 130 to tailor user requests for transferring currency in relation to a game application. For example, network interface 107 may receive currency transfer information from payment service provider 130, and user 102 may use user interface 108 to identify a transfer amount, a target user (e.g., user 112) for the transfer amount, and a game application to which the transfer is related, and use network interface 107 send this information to payment service provider 130.

Similarly, user device 114 includes a network interface 117 and a user interface 118 that enable user 112 to interact with payment service provider 130. For example, user device 114 may receive a transfer notification that currency has been transferred to user 112's account in relation to the game application. For example, network interface 117 may receive currency transfer information from payment service provider 130, and the transfer information may be displayed to user 112 via user interface 118.

Payment service provider 130 receives and services requests for electronic currency transfers. For example, payment service provider 130 may enable user 102 to transfer an amount of currency from user 102's account to user 112's account in relation to a game application (e.g., game application 106).

Payment service provider 130 includes a user account database 132. User account database 132 stores user account information on a plurality of users. Each user of the plurality of users may have a user account with payment service provider 130 and be associated with one or more game applications. Payment service provider 130 may be associated with a particular link (e.g., a link, such as a URL (Uniform Resource Locator) to an IP (Internet Protocol) address). A user may register with payment service provider 130 by navigating to the URL associated with payment service provider 130, creating a username and password, and providing enrollment information (e.g., name, address, bank account information, and credit card information) to payment service provider 130. Payment service provider 130 may create an account for the user based on the enrollment information and store this information in user account database 132. Thereafter, the user may access his account by logging into a website of payment service provider 130 and providing the username and password. Payment service provider 130 may authenticate the user and identify information on the logged-in user based on the username and password.

Payment service provider 130 also includes a currency game transferor 136. Currency game transferor 136 may interface with network 120 to exchange information with user device 102, user device 112, and game server 140. In an embodiment, user 102 exchanges information with currency game transferor 136 to electronically transfer currency from user 102's account to user 112's account in relation to game application 106. Currency game transferor 136 may store the transaction history of the users in user account database 132.

User 102 may decide to transfer an amount of currency from his user account to user 112's user account in relation to game application 106. User 102 may decide to transfer the amount because he is aware that user 112 is running low on money and is unable to purchase equipment in game application 106. For example, users 102 and 112 may be friends who talk about their game status. During their conversation, user 112 may inform user 102 that user 112 is unable to purchase equipment in game application 106 because he is running low on money. In another example, payment service provider 130 maintains user 112's currency balance specific to game application 106. If the currency balance specific to game application 106 is less than a threshold amount, payment service provider 130 sends user 102 a notification that user 112's currency balance specific to game application 106 is less than the threshold amount. User 102 may then be aware that user 112 is running low on money. Users may opt out of payment service provider 130 sending notifications to other users (e.g., teammates). In another example, game application 106 may provide a status update to user 102 regarding user 112's status, and user 102 may then notice that user 112 is in need of in-game currency to purchase equipment in the game.

For simplicity, user 102 is described as the source user who transfers currency to another account, and user 112 is described as the target user who receives currency from the source user. It should be understood that in other transactions, user 102 may be the target user and user 112 may be the source user.

In an example, users 102 and 112 have user accounts with payment service provider 130, and user account database 132 stores user account information on users 102 and 112. Further, users 102 and 112 may each be associated with game application 106 and other game applications (not shown). Currency game transferor 136 searches user account database 132 to identify one or more game applications associated with a user. In an example, game application 106 is set up to use payment service provider 130, and payment service provider 130 recognizes the game applications that the user plays. These recognized game applications may be associated with the user. In another example, a user is associated with a game application if the user has purchased game currency specific to the game application via payment service provider 130. In another example, a user is associated with a game application if the user is registered with the game application, and the payment service provider 130 is notified of the registration.

In an embodiment, the one or more game applications associated with user 102 are linked to payment service provider 130. The identified one or more game applications may be linked to payment service provider 130 by user 102's account information.

Currency game transferor 136 may transmit the information on the identified one or more game applications to user device 104 for display to user 102. Currency game transferor 136 may also receive user selections such as selections for a game application in relation to a currency transfer, a target user for the currency transfer, and an amount of currency to transfer from the source user's account to the target user's account.

User 102 may select a game application of the identified one or more game applications, and network interface 107 may transmit the game application selection information to payment service provider 130. Currency game transferor 136 may receive from user device 104 the selected game application. The selected game application may be associated with a user selectable option to transfer currency from user 102's account to another user account associated with the selected game application via payment service provider 130.

Each game application may be associated with a plurality of users. In an example, game application 106 is associated with users 102 and 112 and may also be associated with other users (not shown). Currency game transferor 136 may identify one or more users associated with the selected game application. To identify these users, currency game transferor 136 may search user account database 132 for users who are associated with the selected game application. Currency game transferor 136 may also search user account database 132 for users satisfying an additional criterion. For example, currency game transferor 136 may search user account database 132 for users who are associated with the selected game application and associated with user 102. For instance, the identified one or more users associated with the selected game application may be in a common team with user 102. In another example, user 102 may specify a list of users (e.g., friends), and currency game transferor 136 may associate user 102 with the list of users and store this association in user account database 132. In this example, currency game transferor 136 may search user account database 132 for users who are associated with the selected game application and listed in user's 102 list of users.

After currency game transferor 136 identifies the one or more users associated with the selected game application, currency game transferor 136 may transmit the information on the identified one or more users associated with the selected game application and the information on the user selectable option to transfer currency to user device 104 for display to user 102.

User 102 may select a target user from the identified one or more users associated with the selected game application to whom to transfer the currency. In response to user 102's user selection, network interface 107 may transmit the information associated with the user selection to payment service provider 130. Currency game transferor 136 may receive from user device 104 a selection of a target user of the identified one or more users associated with the selected game application. Currency game transferor 136 may also receive from user device 104 a request to transfer an amount of currency from user 102's account to the target user's account.

When currency game transferor 136 receives the transfer request, user account database 132 may be searched for account information. Currency game transferor 136 may search user account database 132 to ensure that user 102 has sufficient funds to satisfy the transfer request. In an embodiment, currency game transferor 136 may determine user 102's account balance. When user 102's account balance is greater than or equal to the requested transfer amount, currency game transferor 136 may transfer the requested amount of currency from user 102's account to user 112's account. Currency game transferor 136 may accordingly update user account database 132 by decreasing user 102's account balance by the transferred amount and increasing user 112's account balance by the transferred amount. Currency game transferor 136 may transmit a notification to the target user that currency has been transferred to the target user's account for the selected game application. In contrast, when user 102's account balance is less than the requested transfer amount, currency game transferor 136 may transmit a notification to user 102 that user 102's account balance is less than the requested transfer amount.

Payment service provider 130 may enable user 112 to purchase game currency specific to game application 106 using the transferred currency. For example, user 112 may log onto a website of payment service provider 130 and using the transferred currency, purchase game currency specific to game application 106. In another example, user 112 may launch game application 106 and purchase game currency specific to game application 106 by selecting an option provided by game application 106 to use payment service provider 130 for the payment. Payment service provider 130 may accordingly use the transferred currency in user 112's account to purchase the game currency specific to game application 106.

Payment service provider 130 may restrict the amount transferred to the target user account to be used solely to purchase game currency specific to the selected game application. In an example, for each game application associated with user 112, payment service provider 130 may maintain an account balance corresponding to an amount of currency that has been transferred to user 112's account in relation to the particular game application. For instance, when user 102 transfers an amount of currency to user 112's account to be used for game application 106, the account balance specific to game application 106 is increased by the transferred amount. Similarly, when user 112 purchases game currency specific to game application 106 using the transferred currency, the account balance specific to game application 106 is decreased by the purchase amount. In this way, a source user may be assured that the target user will use the transferred currency for the source user's intended purpose (e.g., purchasing game currency specific to game application 106).

Payment service provider 130 may determine a balance of the target user account. When the balance of the target user account satisfies a threshold, payment service provider 130 may transmit a notification to the source user regarding the target user's account balance. In an example, the target user's account balance may satisfy the threshold when the target user's account balance is less than a threshold amount. The notification may be sent to the target user's teammates (e.g., source user and others) to alert them that the target user's account balance is low.

Payment service provider 130 may provide more precise information by maintaining a balance specific to each game application. In an embodiment, for each game application associated with a user, payment service provider 130 may determine a balance specific to that game application. In an example, payment service provider 130 may determine a balance specific to the game application of the target user's account. When the balance specific to the game application satisfies a threshold, payment service provider 130 may transmit a notification to the source user regarding the target user's account balance. In an example, the target user's account balance specific to the game application may satisfy the threshold when the target user's account balance specific to the game application is less than a threshold amount. The notification may be sent to the target user's teammates (e.g., source user and others) to alert them that the target user's account balance specific to the game application is low. In another example, the target user's account balance specific to the game application may satisfy the threshold when the target user's account balance specific to the game application is decreased by the amount that the source user transferred to the target user's account. In this way, the source user may be informed when the target user has spent the total amount of currency transferred from the source user account to the target user account.

FIG. 1 illustrates an exemplary embodiment of a network-based system 100 for implementing one or more processes described herein. As shown, network-based system 100 may include or implement a plurality of servers and/or software components that operate to perform various methodologies in accordance with the described embodiments. Exemplary servers may include, for example, stand-alone and enterprise-class servers operating a server OS such as a MICROSOFT® OS, a UNIX® OS, a LINUX® OS, or other suitable server-based OS. It can be appreciated that the payment service provider illustrated in FIG. 1 may be deployed in other ways and that the operations performed and/or the services provided by such servers may be combined or separated for a given implementation and may be performed by a greater number of servers. One or more servers may be operated and/or maintained by the same or different entities.

III. Example Displays to Specify Transfer Information in Relation to a Game Application FIGS. 2A-2D show a sequence of displays displayed to the source user to specify transaction information for the electronic transfer in relation to the game application, according to an embodiment of the present disclosure.

Figure 2A:
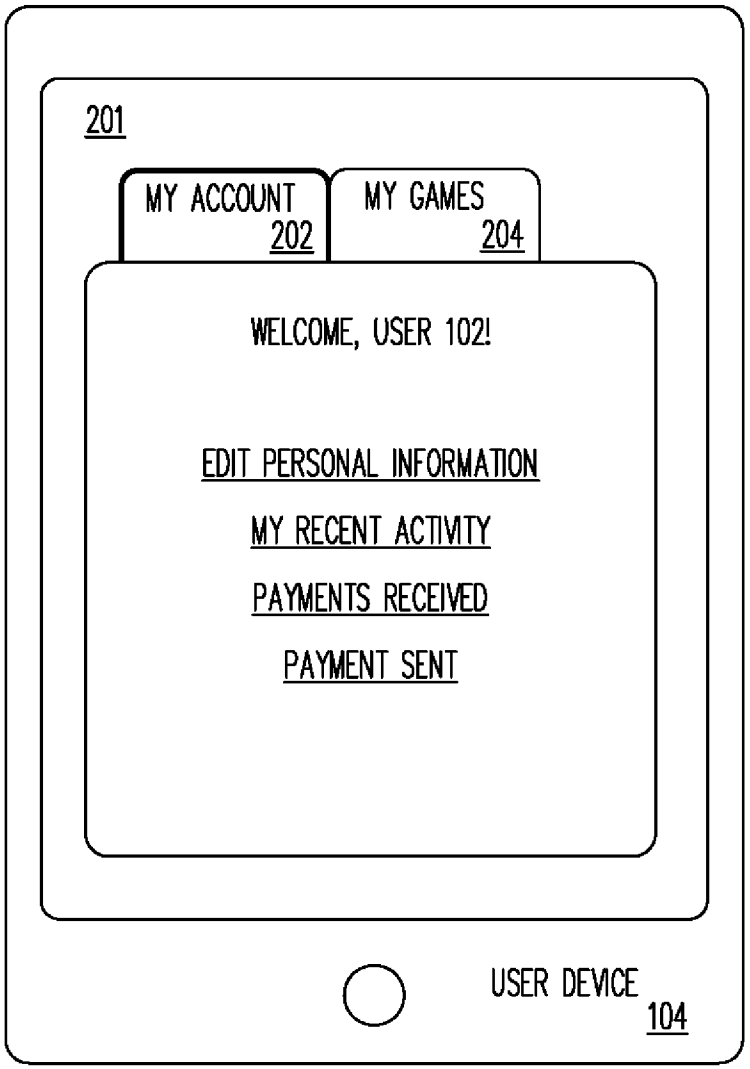
FIGS. 2A-2D show a sequence of displays displayed to the source user to specify transaction information for the electronic transfer in relation to the game application, according to an embodiment of the present disclosure.

FIG. 2A shows an example webpage 201 from payment service provider 130 displayed to user 102. Webpages may be displayed on user device 104, 114 via user interface 108, 118. Webpage 201 includes a "My Account" tab 202 and a "My Games" tab 204. Each of tabs 202 and 204 may be selectable by user 102. In "My Account" tab 202, a welcome message is displayed via user interface 108 along with links that user 102 may select to edit personal information and view transactional history (e.g., recent activity, payments received, or payments sent). User account database 132 may store this information along with other information, and when user 102 selects one of these options user account database 132 may be queried for the applicable information.

Figure 2B:
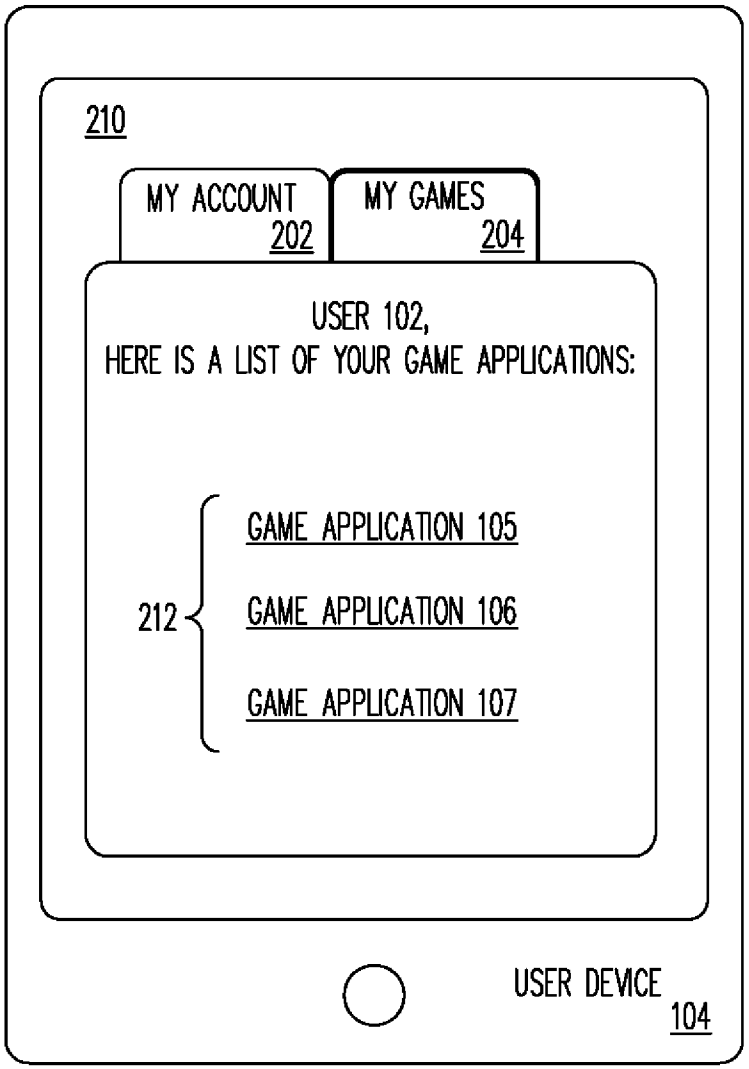

User 102 may select "My Games" tab 204. FIG. 2B shows an example webpage 210 from payment service provider 130 displayed to user 102 in response to user 102 selecting "My Games" tab 204. In an embodiment, in response to user 102 selecting "My Games" tab 204, payment service provider 130 searches user account database 132 to identify one or more game applications associated with user 102. In another embodiment, payment service provider 130 may perform this search before user 102 selects "My Games" tab 204. For example, in response to user 102 logging onto the website of payment service provider 130, payment service provider 130 may search user account database 132 to identify one or more game applications associated with user 102.

In webpage 210, a list of game applications 212 associated with user 102 and linked to payment service provider 130 are displayed. List of game applications 212 includes game application 105, game application 106, and game application 107. Three game applications are shown in webpage 210, but it should be understood that user 102 may be associated with fewer than three or more than three game applications.

User 102 may select a game application displayed on webpage 210. Inputting of a user selection may be done in any number of ways. In an example, user 102 may use a touch-screen to make a selection. For instance, user 102 may select game application 106 by touching the touch-screen with an object (e.g., finger or stylus) at a position corresponding to game application 106. In another example, user 102 may use a cursor to make a selection. In another example, user 102 may manually type in a selection using a keypad or keyboard. For instance, the game applications may be displayed along with an empty text box (not shown). User 102 may then manually type the name of the game application into the text box. In another example, user 102 may select items from a list, such as a drop down menu. For instance, a user may select a game application from a drop down menu of one or more game applications. In an embodiment, user interface 108, 118 includes a software program, such as a graphical user interface (GUI), executable by a processor and configured to interface with user 102, 112.

Figure 2C:
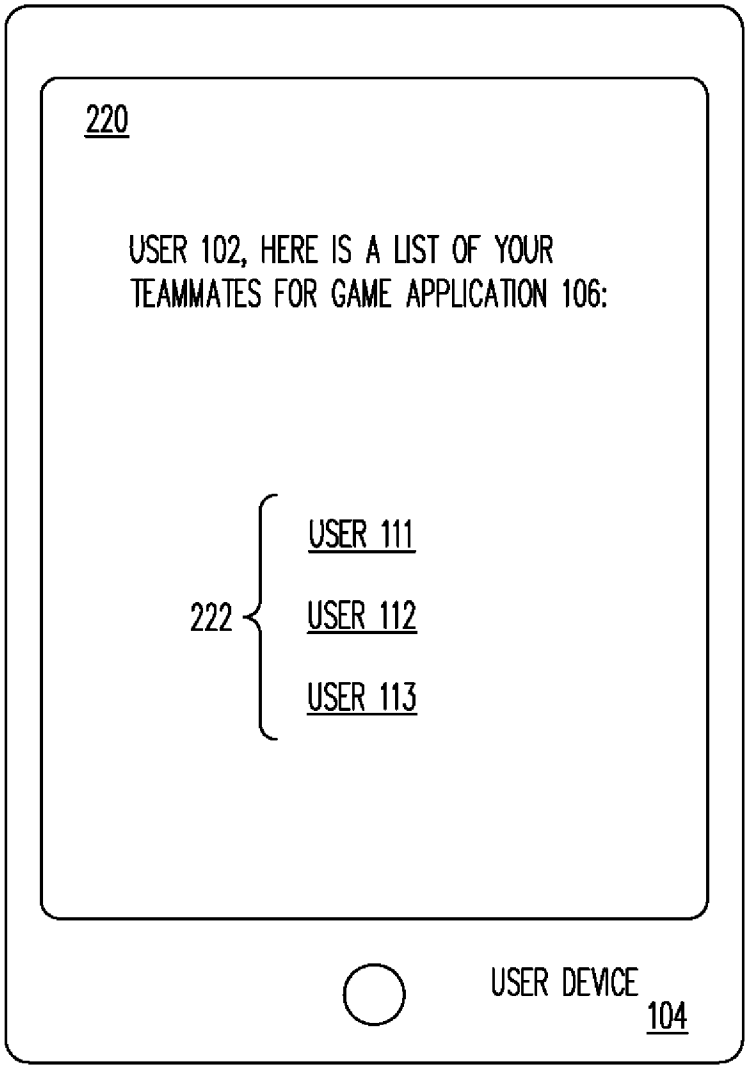

In an example, user 102 selects game application 106 as the game application related to the electronic currency transfer request. FIG. 2C shows an example webpage 220 from payment service provider 130 displayed to user 102 in response to user 102 selecting game application 106. In webpage 220, a list of users 222 associated with game application 106 is displayed. List of users 222 includes user 111, user 112, and user 113. Three users are shown in webpage 220, but it should be understood that game application 106 may be associated with fewer than three or more than three users.

Figure 2D:
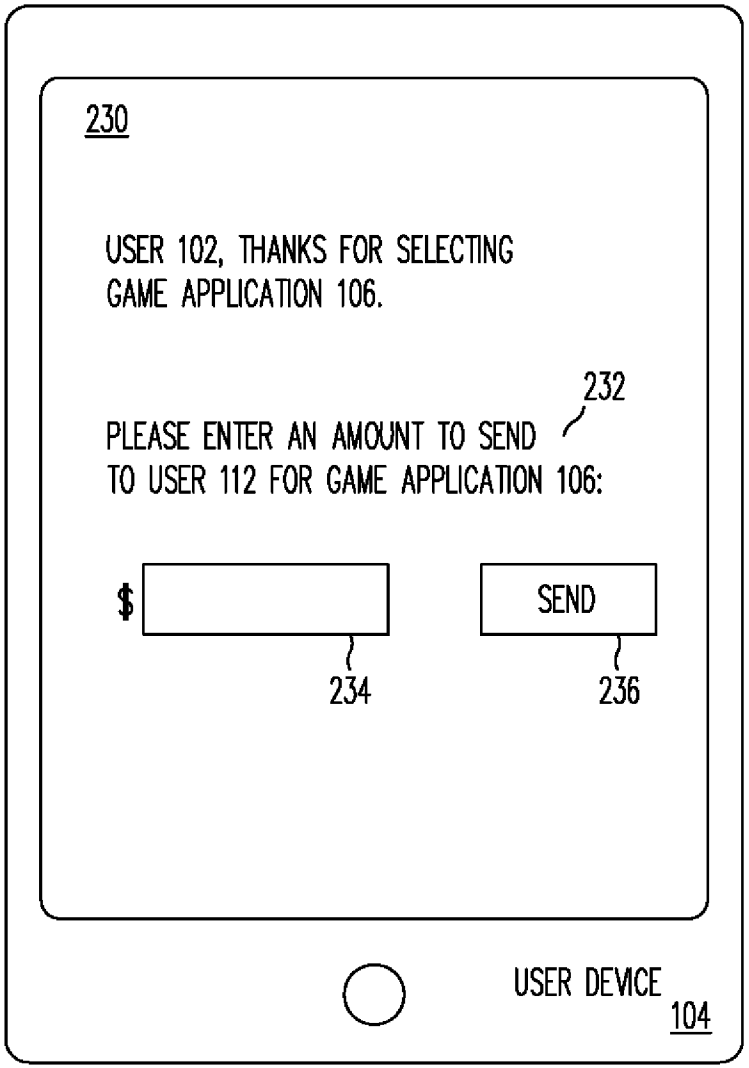

User 102 may select a target user in list of users 222 to whom to transfer currency. In an example, user 102 selects user 112 as the target user. FIG. 2D shows an example webpage 230 from payment service provider 130 displayed to user 102 in response to user 102 selecting user 112 as the target user. In webpage 230, a prompt 232 requesting how much user 102 would like to transfer to user 112 for game application 106, a text box 234 in which the user may enter an amount of currency to transfer from user 102's account to user 112's account, and a user selectable option 236 to transmit the transaction information to payment service provider 130 are displayed.

As discussed, FIGS. 2A-2D show a sequence of displays displayed to the source user to specify transaction information for the electronic transfer in relation to the game application, according to an embodiment of the present disclosure. In another embodiment, payment service provider 130 provides the source user with more or fewer webpages in which the source user enters information to complete the currency transfer related to the game application. For example, payment service provider 130 may provide user 102 with a single webpage that allows the source user to select a game application to which the transfer is related, a target user, and a transfer amount.

Figure 3:
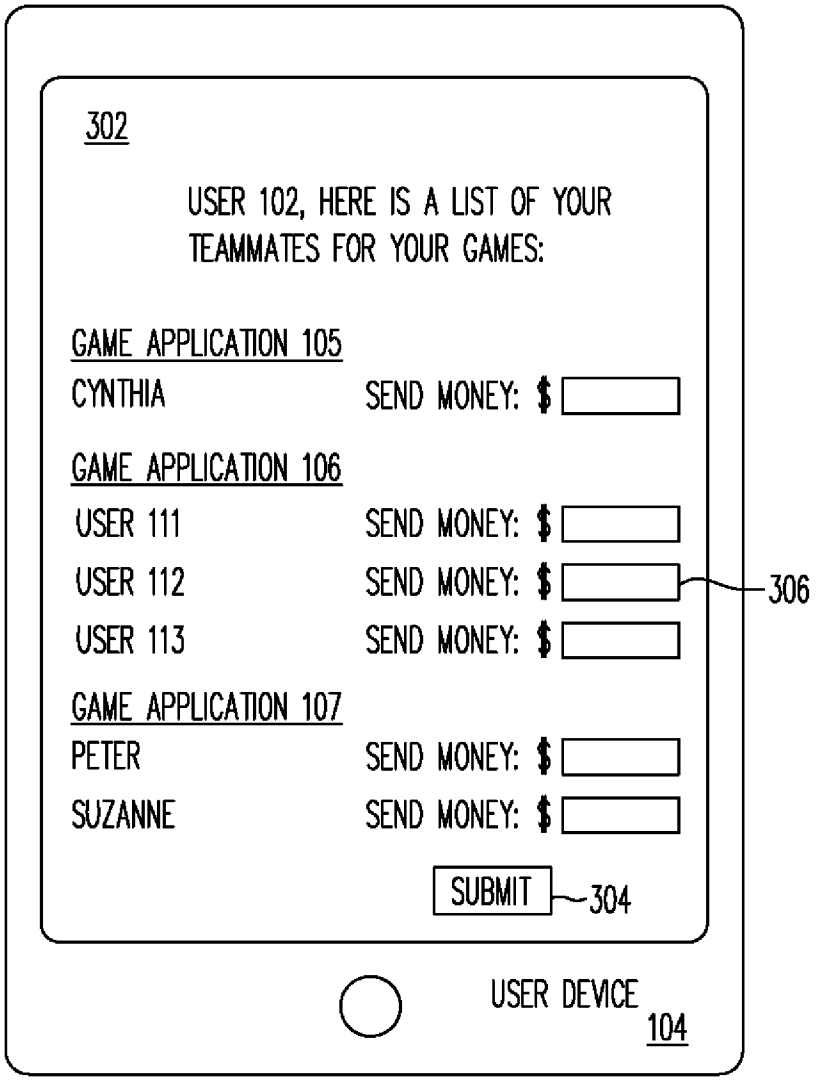
FIG. 3 shows another display displayed to the source user to specify transaction information for the electronic transfer in relation to the game application, according to an embodiment of the present disclosure.

FIG. 3 shows another display displayed to the source user to specify transaction information for the electronic transfer in relation to the game application, according to an embodiment of the present disclosure. FIG. 3 shows an example webpage 302 from payment service provider 130 displayed to user 102. Webpage 302 includes a list of one or more game applications associated with user 102 and linked to payment service provider 130. The list of game applications includes game applications 105, 106, and 107. Webpage 302 also includes a list of users associated with each of the displayed game applications and an input box in which the source user can enter a transfer amount. The list of users for game application 105 includes Cynthia, the list of users for game application 106 includes users 111, 112, and 113, and the list of users for game application 107 includes Peter and Suzanne.

User 102 may select a game application to which the transfer is related, a target user, and a transfer amount by entering the transfer amount in the applicable box and selecting a box 304 to transmit the information to payment service provider 130. For example, user 102 may select game application 106 as the game application to which the transfer is related, user 112 as the target user, and $10 as the transfer amount by entering $10.00 in a box 306, and then selecting box 304. In response to user 102 selecting box 304, network interface 107 may send a request to payment service provider 130 to transfer $10.00 from user 102's account to user 112's for game application 106.

In an embodiment, currency game transferor 136 searches user account database 132 to identify one or more game applications associated with a first user of the plurality of users having a first user account and to identify one or more users of the plurality of users associated with the selected game application. The identified one or more game applications is linked to a payment service provider. The identified one or more game applications is associated with a user selectable option to transfer currency from the first user account to another user account associated with the selected game application via the payment service provider. Currency game transferor 136 transmits the information on the identified one or more game applications to a computing device for display to the first user and also transmits the information on the identified one or more users associated with the identified one or more game applications and the information on the user selectable option to transfer currency to the computing device for display to the first user. Currency game transferor 136 receives from the computing device a selection of a game application of the identified one or more game applications, receives from the computing device a selection of a target user of the identified one or more users associated with the selected game application, and also receives from the computing device a request to transfer an amount of currency from the first user account of the first user to a target user account of the target user. Currency game transferor 136 processes the request accordingly.

Figure 4:
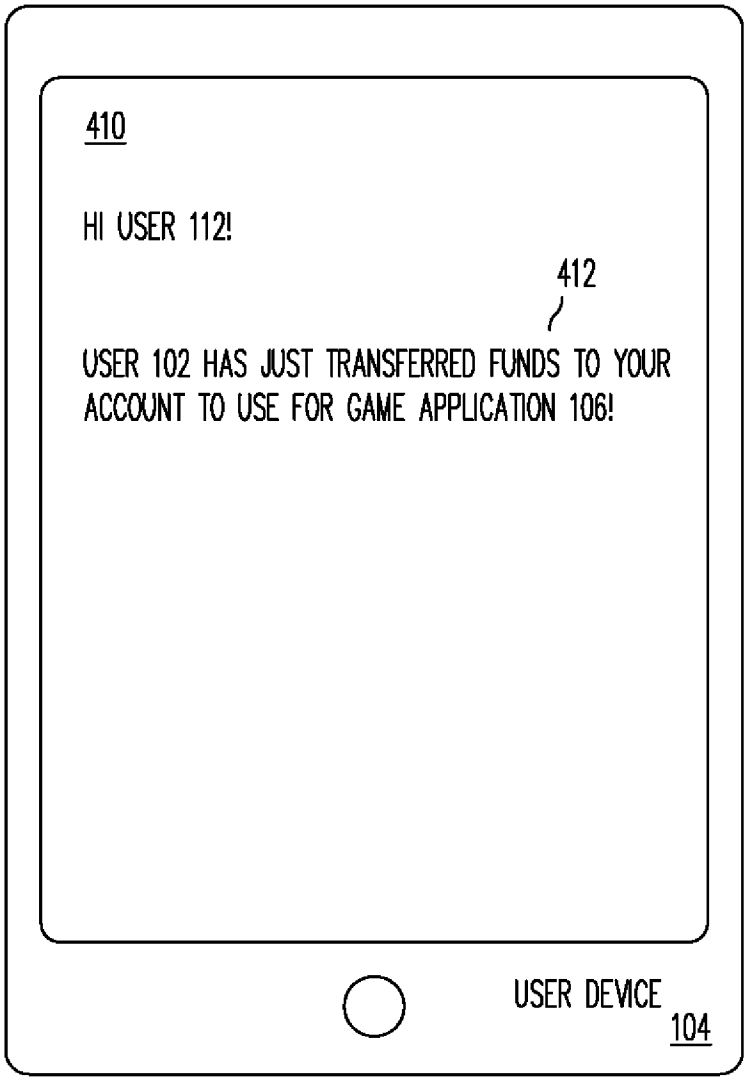
FIG. 4 shows a notification displayed to the target user that currency has been transferred to the user account of the target user, according to an embodiment of the present disclosure.

As discussed above, currency game transferor 136 may transmit a notification to the target user that currency has been transferred to the account of the target user for the selected game application. FIG. 4 shows a notification displayed to the target user that currency has been transferred to the target user's account, according to an embodiment of the present disclosure. In FIG. 4, an example webpage 410 from payment service provider 130 is displayed to user 112 in response to user 102 transferring currency from user 102's account to user 112's account for game application 106. In webpage 410, a message 412 is displayed. Message 412 is "User 102 has just transferred funds to your account to use for Game Application 106!" Other messages that may be provided to user 112 may give user 112 more information (e.g., the source user, transfer amount, transaction date).

In an embodiment, in webpage 410, a URL associated with payment service provider 130 is also displayed (not shown). If user 112 selects the URL, payment service provider 130 may transmit information to user device 114 that enables user 112 to purchase game currency specific to game application 106 using the transferred currency. In another embodiment, user 112 may type in the URL associated with payment service provider 130 to purchase game currency specific to game application 106 using the transferred currency. In another embodiment, user 112 may launch game application 106 and purchase game currency specific to game application 106 by selecting an option provided by game application 106 to use payment service provider 130 for the payment. Payment service provider 130 may accordingly use the transferred currency in user 112's account to purchase the game currency specific to game application 106.

IV. Example Method

Figure 5:
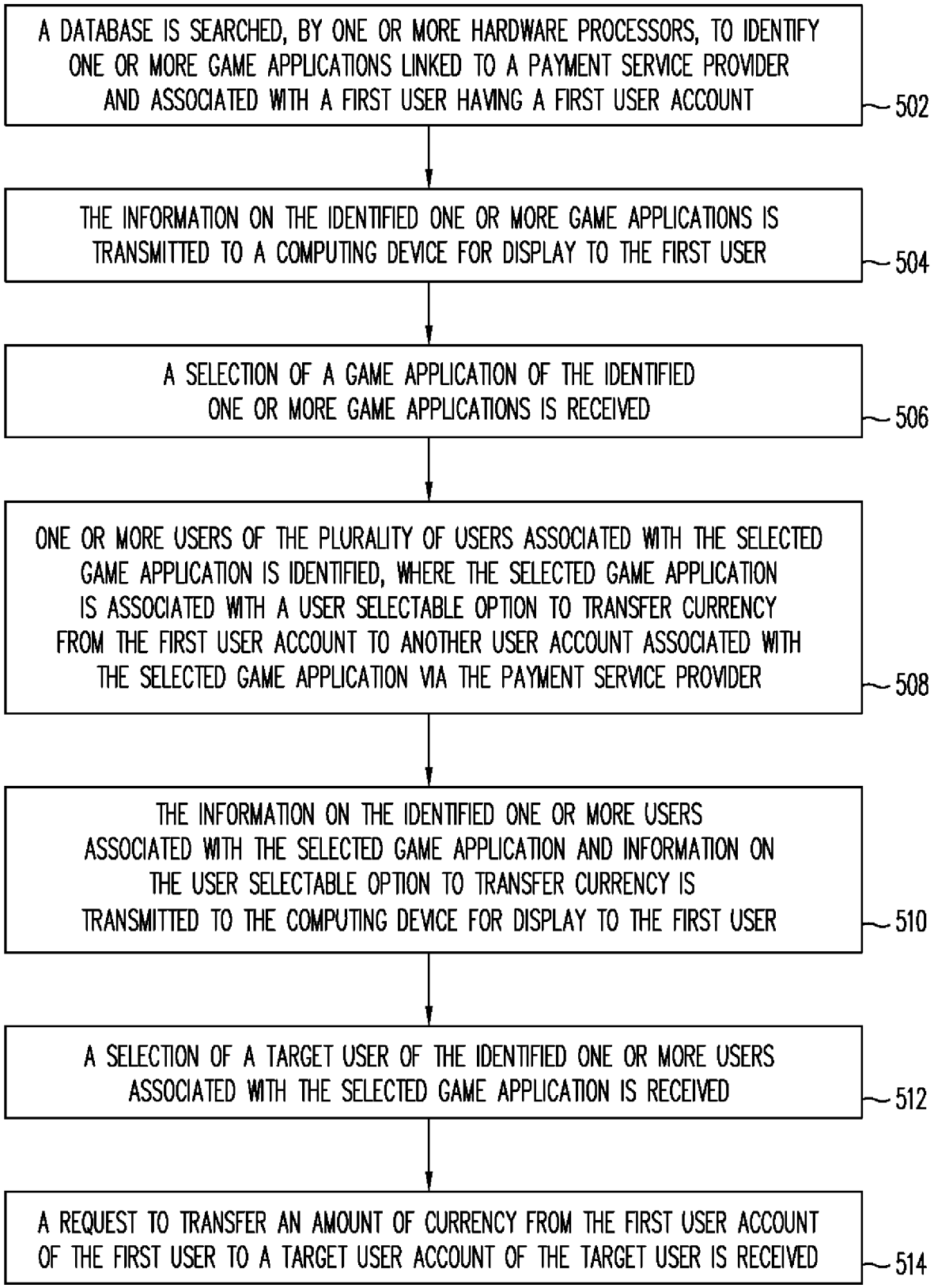
FIG. 5 shows a flow chart of the steps for the payment service provider to electronically transfer currency from the source user account to the target user account in relation to the game application, according to an embodiment of the present disclosure.

FIG. 5 shows a flow chart of the steps for the payment service provider to electronically transfer currency from the source user account to the target user account in relation to the game application, according to an embodiment of the present disclosure.

The source user wants to transfer currency from the source user's account to the target user's account in relation to the game application. In a step 502, a database is searched, by one or more hardware processors, to identify one or more game applications linked to a payment service provider and associated with a first user having a first user account. In a step 504, the information on the identified one or more game applications is transmitted to a computing device for display to the first user. In a step 506, a selection of a game application of the identified one or more game applications is received. In a step 508, one or more users of the plurality of users associated with the selected game application is identified. The selected game application is associated with a user selectable option to transfer currency from the first user account to another user account associated with the selected game application via the payment service provider.

In a step 510, the information on the identified one or more users associated with the selected game application and information on the user selectable option to transfer currency is transmitted to the computing device for display to the first user. In a step 512, a selection of a target user of the identified one or more users associated with the selected game application is received. In a step 514, a request to transfer an amount of currency from the first user account of the first user to a target user account of the target user is received.

V. Example Computing System

Figure 6:
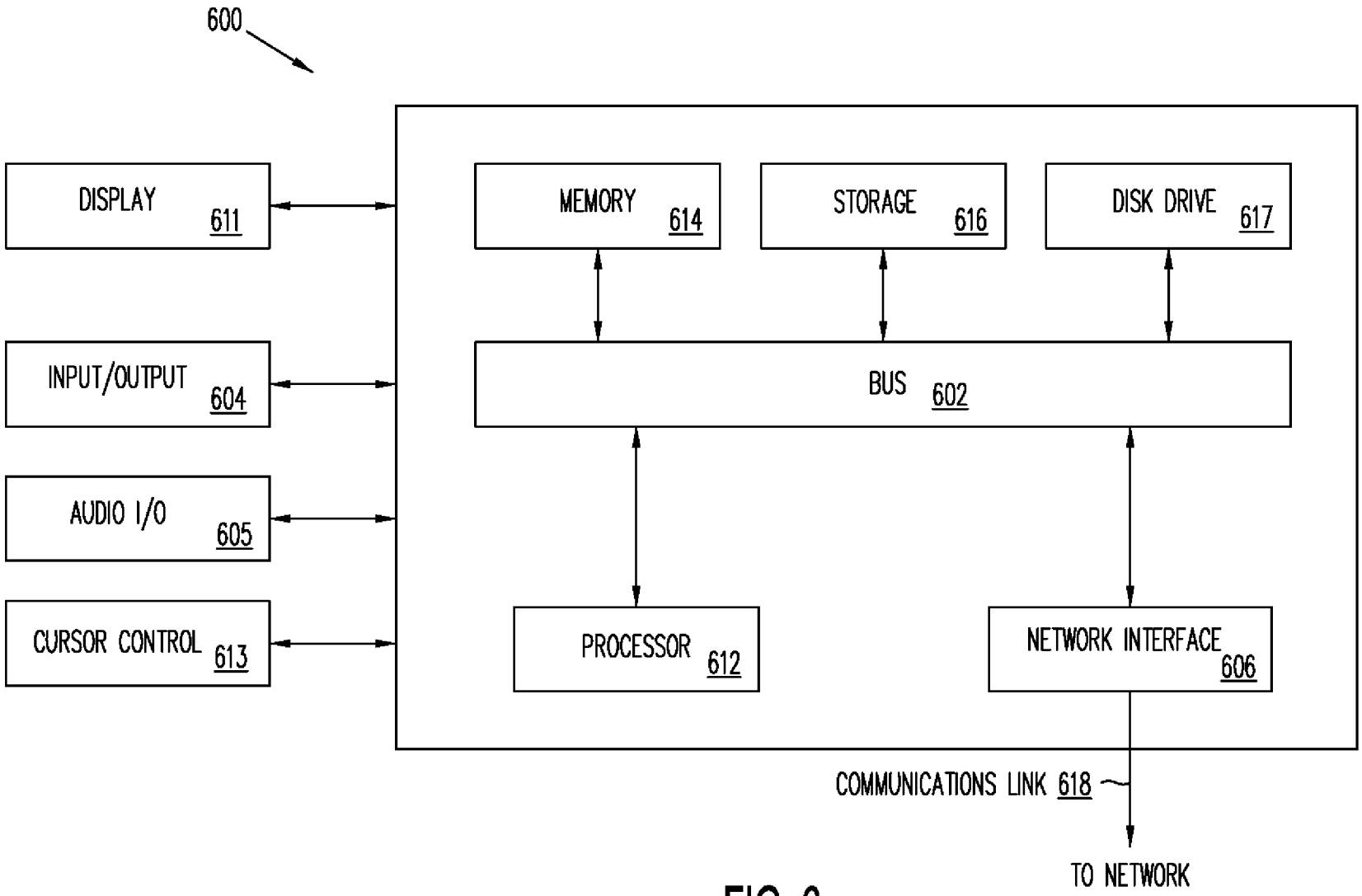
FIG. 6 is a block diagram of a computer system suitable for implementing one or more components discussed herein, according to an embodiment of the present disclosure.

FIG. 6 is a block diagram of a computer system 600 suitable for implementing one or more embodiments of the present disclosure. In various implementations, the mobile device of the user may include a personal computing device (e.g., smart phone, a computing tablet, a personal computer, laptop, PDA, Bluetooth device, key FOB, badge, etc.) capable of communicating with the network. The payment service provider may utilize a network computing device (e.g., a network server) capable of communicating with the network. It should be appreciated that each of the devices utilized by users and payment service provider may be implemented as computer system 600 in a manner as follows.

Computer system 600 includes a bus 602 or other communication mechanism for communicating information data, signals, and information between various components of computer system 600. Components include an input/output (I/O) component 604 that processes a user action, such as selecting keys from a keypad/keyboard, selecting one or more buttons or links, etc., and sends a corresponding signal to bus 602. I/O component 604 may also include an output component such as a display 611, and an input control such as a cursor control 613 (such as a keyboard, keypad, mouse, etc.). An optional audio input/output component 605 may also be included to allow a user to use voice for inputting information by converting audio signals into information signals. Audio I/O component 605 may allow the user to hear audio. A transceiver or network interface 606 transmits and receives signals between computer system 600 and other devices, such as another user device or a payment service provider server via a communication link 618 to a network. In an embodiment, the transmission is wireless, although other transmission mediums and methods may also be suitable. A processor 612, which can be a micro-controller, digital signal processor (DSP), or other processing component, processes these various signals, such as for display on computer system 600 or transmission to other devices via communication link 618. Processor 612 may also control transmission of information, such as cookies or IP addresses, to other devices.

Components of computer system 600 also include a system memory component 614 (e.g., RAM), a static storage component 616 (e.g., ROM), and/or a disk drive 617. Computer system 600 performs specific operations by processor 612 and other components by executing one or more sequences of instructions contained in system memory component 614. Logic may be encoded in a computer readable medium, which may refer to any medium that participates in providing instructions to processor 612 for execution. Such a medium may take many forms, including but not limited to, non-volatile media, volatile media, and transmission media. In various implementations, non-volatile media includes optical, or magnetic disks, or solid-state drives, volatile media includes dynamic memory, such as system memory component 614, and transmission media includes coaxial cables, copper wire, and fiber optics, including wires that include bus 602. In an embodiment, the logic is encoded in non-transitory computer readable medium. In an example, transmission media may take the form of acoustic or light waves, such as those generated during radio wave, optical, and infrared data communications.

Some common forms of computer readable media includes, for example, floppy disk, flexible disk, hard disk, magnetic tape, any other magnetic medium, CD-ROM, any other optical medium, punch cards, paper tape, any other physical medium with patterns of holes, RAM, PROM, EEPROM, FLASH-EEPROM, any other memory chip or cartridge, or any other medium from which a computer is adapted to read.

In various embodiments of the present disclosure, execution of instruction sequences to practice the present disclosure may be performed by computer system 600. In various other embodiments of the present disclosure, a plurality of computer systems 600 coupled by communication link 618 to the network (e.g., such as a LAN, WLAN, PTSN, and/or various other wired or wireless networks, including telecommunications, mobile, and cellular phone networks) may perform instruction sequences to practice the present disclosure in coordination with one another.

Where applicable, various embodiments provided by the present disclosure may be implemented using hardware, software, or combinations of hardware and software. Also where applicable, the various hardware components and/or software components set forth herein may be combined into composite components including software, hardware, and/or both without departing from the spirit of the present disclosure. Where applicable, the various hardware components and/or software components set forth herein may be separated into sub-components including software, hardware, or both without departing from the spirit of the present disclosure. In addition, where applicable, it is contemplated that software components may be implemented as hardware components, and vice-versa.

Application software in accordance with the present disclosure, such as computer programs executed by a processor of the payment service provider to search a database to identify one or more game applications linked to a payment service provider and associated with a user, identifying one or more users associated with a game application, and processing a request to transfer an amount of currency from a source user's account to a target user's account, may be stored on one or more computer readable mediums. It is also contemplated that the application software identified herein may be implemented using one or more general purpose or specific purpose computers and/or computer systems, networked and/or otherwise. Where applicable, the ordering of various steps described herein may be changed, combined into composite steps, and/or separated into sub-steps to provide features described herein.

Although embodiments of the present disclosure have been described, these embodiments illustrate but do not limit the disclosure. It should also be understood that embodiments of the present disclosure should not be limited to these embodiments but that numerous modifications and variations may be made by one of ordinary skill in the art in accordance with the principles of the present disclosure and be included within the spirit and scope of the present disclosure as hereinafter claimed.

I claim:

1. A system comprising:

a non-transitory memory storing instructions; and one or more hardware processors coupled to the non-transitory memory and configured to read the instructions from the non-transitory memory to cause the system to perform operations comprising:

receiving a first selection of a first game application from a device of a first user;

detecting, via a network interface with the first game application, that an in-game balance of a second user account of a second user in the first game application is below a threshold for purchase of a virtual item in the first game application by the second user account;

determining a plurality of game account balances for the first user with one or more additional game applications, wherein the one or more additional game applications are linked to a first user account of the first user based on past purchases of application currency through the first user account with the one or more additional game applications;

transmitting first game information for the first game application with the plurality of game account balances to the device through an interface associated with the first user account of the first user, wherein the first game information comprises an option for a transfer to the second user account of the second user associated with the first game application and the plurality of game account balances;

receiving a second selection of the option from the interface;

receiving a second request to process the transfer to the second user through the interface; and processing the transfer through a payment service provider based on the second request.

2. The system of claim 1, wherein the operations further comprise:

providing access to the plurality of game account balances through the first user account.

3. The system of claim 1, wherein the operations further comprise:

receiving, from the device, a third selection of a second game application through the interface; and transmitting second game information for the second game application to the device through the interface of the first user account.

4. The system of claim 3, wherein the interface further comprises game monitoring information of the second user in at least one of first game application or the second game application.

5. The system of claim 4, wherein the game monitoring information comprises at least one of item information for the virtual item in the at least one of first game application or the second game application, game currency balance information in the at least one of first game application or the second game application, or a character status for a virtual character in the at least one of first game application or the second game application.

6. The system of claim 1, wherein the second request comprises an amount for the transfer, and wherein the operations further comprise:

providing the amount to the second user account of the second user based on the processing.

7. The system of claim 6, wherein the second user account comprises an in-game account of the second user with the first game application, and wherein the amount comprises an in-game currency for the in-game balance of the first game application.

8. The system of claim 6, wherein the second user account comprises a currency account of the second user with the payment service provider, and wherein the amount comprises a monetary currency from the first user account.

9. The system of claim 8, wherein the operations further comprise:

notifying the first user of one of a purchase or a transfer by the second user using the monetary currency of the amount.

10. The system of claim 6, wherein the operations further comprise:

notifying the second user of the providing the amount to the second user account by the first user during a detected game session of the second user with the first game application.

11. The system of claim 6, wherein the second request further comprises a specification of a use for the amount by the second user, and wherein the operations further comprise:

restricting the use of the amount based on the specification.

12. A method comprising:

providing, through a website of a service provider, a first device of a first user access to a first account with the website through a first user interface of the website, wherein the first account is linked to a plurality of game applications;

receiving to a first selection of a game application from the plurality of game applications through the first user interface;

detecting, via a network interface with the game application, that an in-game balance of a second account of a second user in the game application is below a threshold for purchase of a virtual item in the game application by the second account;

determining a plurality of game account balances for the first user with the plurality of game applications, wherein the plurality of game applications are linked to the first account of the first user based on past purchases of application currency through the first account with the plurality of game applications;

causing game content for the game application to be displayed through the first user interface of the website on the first device, wherein the game content is associated with the second user playing the game application;

providing a selectable option to process an amount to be provided to the second account of the second user by the first user from the plurality of game account balances through the first user interface; and in response to a second selection of the selectable option, processing the amount to the second account of the second user from a currency provided by the first user through the first account.

13. The method of claim 12, further comprising:

transmitting a notification to a second device of the second user, wherein the notification comprises the amount and the first user.

14. The method of claim 13, wherein the notification is transmitted to the second device during use of the game application by the second user or through a second user interface of the service provider on the second device.

15. The method of claim 12, wherein the currency comprises one of a monetary value, a game currency, or a virtual asset.

16. The method of claim 12, further comprising:

processing a purchase or a transfer by the second user using the currency provided by the first user.

17. The method of claim 12, wherein prior causing the game content to be displayed, the method further comprises:

determining an in-game status of the second user in the game application, wherein the in-game status comprises an in-game option from the first user, wherein the game content further comprises the in-game status.

18. The method of claim 12, wherein the website is further accessible through a dedicated application associated with the service provider.

19. The method of claim 12, wherein the selectable option is provided in response to a request by the second user to the first user.

20. A non-transitory machine-readable medium having stored thereon machine-readable instructions executable to cause a machine to perform operations comprising:

providing, to a device of a first user by a service provider application of a service provider, a list of users participating in an interactive video game application;

receiving, from the device, a selection of a second user from the list of users through an interface of the service provider application;

detecting, via a network interface with the interactive video game application, that an in-game balance of a second user account of the second user in the interactive video game application is below a threshold for purchase of a virtual item in the interactive video game application by the second user account;

determining a plurality of game account balances for the first user with one or more interactive video game applications, wherein the one or more interactive video game applications are linked to a first user account of the first user based on past purchases of application currency through the first user account with the one or more interactive video game applications;

causing, by the device, video game information for the interactive video game application to be-displayed through the interface, wherein the video game information comprises game play information of the second user in the interactive video game application;

providing, to the device, an account balance for the first user account of the first user with the interactive video game application and the one or more interactive video game applications through the interface, wherein the interactive video game application and the one or more interactive video game applications are linked to the first user account of the first user with the service provider, and wherein the account balance is provided based on a past transfer of application currency in the service provider application through the first user account; and receiving, from the device, a transfer request of an amount from the account balance to the second user account of the second user during a display of the video game information by the device.

* * * * *